United States Patent [19]

Yang

[11] Patent Number: 4,909,504

[45] Date of Patent: Mar. 20, 1990

[54] MULTIPURPOSE BODY EXERCISER

[75] Inventor: Chung C. Yang, Tao Yuan, Taiwan

[73] Assignee: Shin Len Hsin Spring Co., Ltd., Tao Yuan, Taiwan

[21] Appl. No.: 322,996

[22] Filed: Mar. 14, 1989

[51] Int. Cl.[4] ..... A63B 21/00

[52] U.S. Cl. ..... 272/130; 272/70; 272/72; 272/134; 272/DIG. 4

[58] Field of Search ..... 272/69, 70, 72, 73, 272/96, 97, 130, 132, 134, DIG. 4

[56] References Cited

U.S. PATENT DOCUMENTS

| | | | |
|---|---|---|---|
| 3,475,021 | 10/1969 | Ruegisegger | 272/97 |
| 3,566,861 | 3/1971 | Weiss | 272/70 X |
| 3,747,924 | 7/1973 | Champoux | 272/70 |
| 3,792,860 | 2/1974 | Selnes | 272/70 X |
| 3,970,302 | 7/1976 | McFee | 272/70 X |
| 4,544,153 | 10/1985 | Babcock | 272/97 |
| 4,563,001 | 1/1986 | Terauds | 272/72 |
| 4,645,197 | 2/1987 | McFee | 272/130 X |
| 4,684,126 | 8/1987 | Dauboot et al. | 272/134 |
| 4,802,856 | 2/1989 | Olson | 272/97 X |
| 4,813,667 | 3/1989 | Watterson | 272/70 X |
| 4,830,362 | 5/1989 | Bull | 272/130 X |

FOREIGN PATENT DOCUMENTS

| | | | |
|---|---|---|---|
| 1260009 | 9/1986 | U.S.S.R. | 272/72 |
| 1599394 | 9/1981 | United Kingdom | 272/70 |
| 84/00496 | 2/1984 | World Int. Prop. O. | 272/72 |

*Primary Examiner*—Richard J. Apley
*Assistant Examiner*—Robert W. Bahr
*Attorney, Agent, or Firm*—Morton J. Rosenberg; David I. Klein

[57] ABSTRACT

A multipurpose body exerciser includes an I-shaped bottom block mated with a vertical main frame and a support frame for mounting of a seat and a back cushion on the main frame. The exerciser further includes two elongated foot-pedals disposed at both sides of the vertical main frame, each respectively suspended by a steel cord hung on a pulley block to provide the foot-pedals for training of the legs. Two vertical rocker rods are provided on opposing sides of the vertical main frame for training of the arms. The foot-pedals and the rocker rods are adjustable by associated hydraulic cylinders, to provide a predetermined tension for providing the best performance appropriate to a user's condition. The whole structure may be divided into three independent portions for convenient transportation or packaging to minimize space requirements.

3 Claims, 9 Drawing Sheets

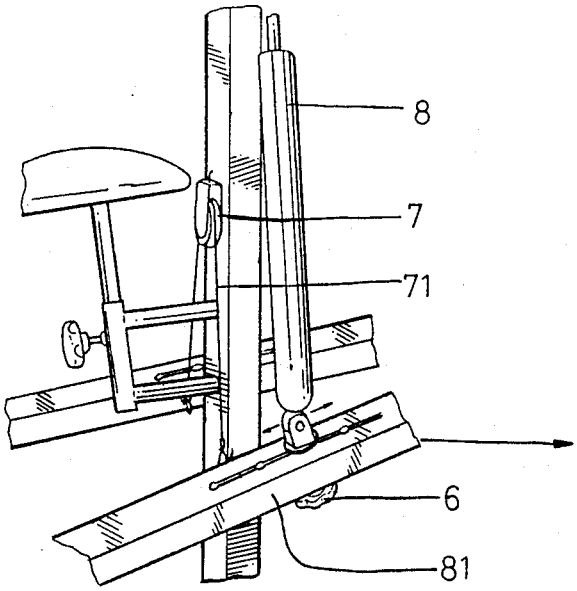
FIG. 3A(I)
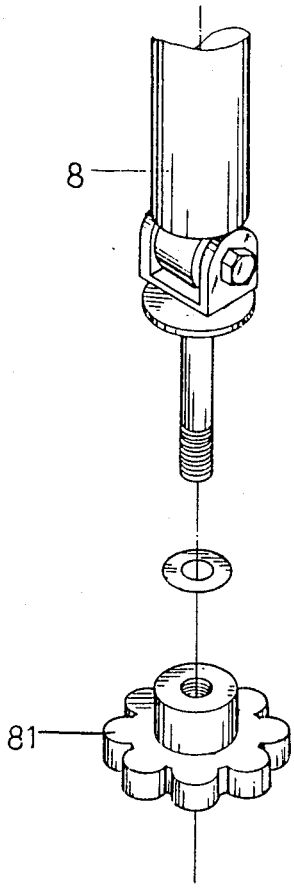
FIG. 3A(II)

MULTIPURPOSE BODY EXERCISER

BACKGROUND OF THE INVENTION

The present invention relates to a type of multipurpose body exerciser and, more particularly, to a multipurpose body exerciser which is applicable for use by two or three or more people at the same time, and which may be detached into three portions for easy transportation and packaging to reduce space requirements.

Regular body exercisers, either rowboat type exercisers or pedal type exercisers, are exclusively for use by a single individual to train on at any one given time. In tee case where two or three people wish to use an exerciser, they must take turns. Further, regular rowboat type exercisers are designed for training arm muscles while regular pedal type exercisers are designed for tailing the legs, that is, regular exercisers provide only a single function.

SUMMARY OF THE INVENTION

The main object of the present invention is to provide a multipurpose body exerciser which comprises foot-pedals and rocker rods for exercising arms and legs simultaneously and which is practical for two or three persons to exercise on, at the same time.

Another object of the present invention is to provide a multipurpose body exerciser which includes four hydraulic cylinders, with one pair for controlling the pedals and with the other pair for controlling the rocker rods. Each of the hydraulic cylinders each comprises an adjustable fastening means for adjusting the tension of the associated cylinder.

A further object of the present invention is to provide a multipurpose body exerciser of which the structure may be conveniently detached into three portions for convenient transportation and packaging to minimize space requirements.

Other objects, features and advantages of the present invention will be more apparent from the following description when considered in connection with the accompanying drawings herein.

BRIEF DESCRIPTION OF THE DRAWINGS

FIG. 3A is a detail view of foot-pedal cylinder adjustment assembly of the present invention;

DESCRIPTION OF THE PREFERRED EMBODIMENTS

Figure 1A:
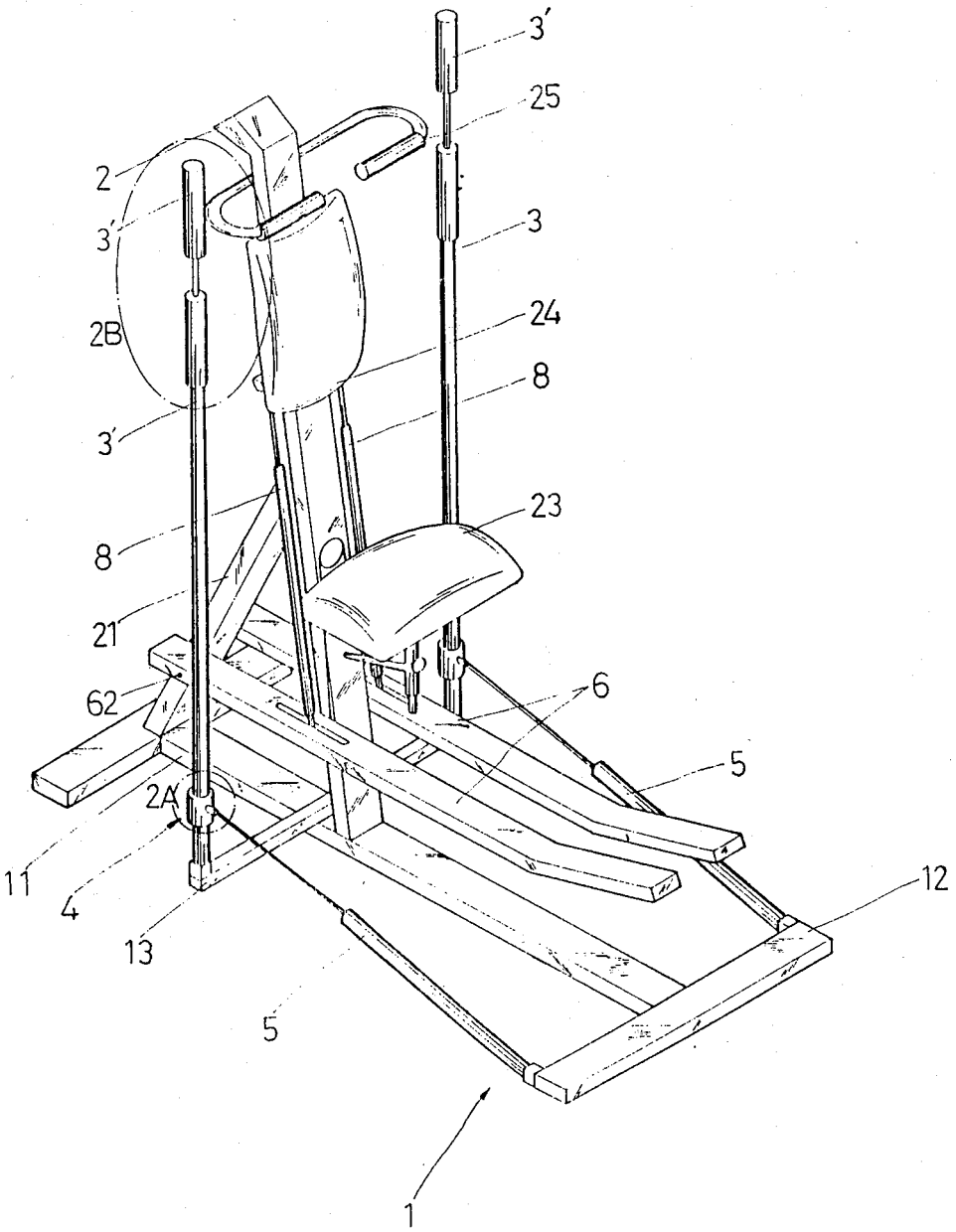
FIG. 1A is a perspective view of the body exerciser embodying the present invention.
Figure 1B:
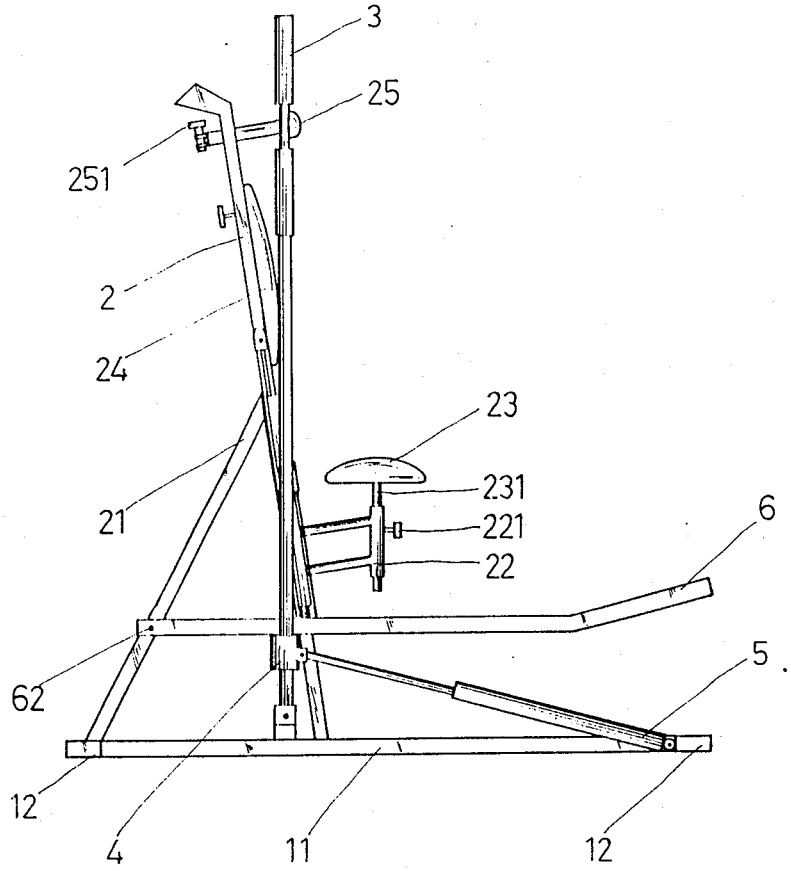
FIG. 1B is an elevation view of the present invention.

Referring to the drawings of FIGS. 1A and 1B, a multipurpose body exerciser includes an I-shaped bottom block (1) to stably support the whole structure while the exerciser in placed on the floor. A main frame (2) is vertically mounted on the middle bar (11) of the bottom block (1) by means of screw type fasteners. A support frame (21) is obliquely disposed to support the main frame (2), with one end attached to the middle portion of the main frame (2) and with the other end fixedly connected to the transverse bar (12 of the bottom block (1) by means of screw type fasteners.

An auxiliary bar (13) is coupled to middle bar (11) adjacent to the connection of the middle bar (11) and the main frame (2). Two vertically disposed rocker rods (3) are respectively each pivotedly connected to opposing ends of auxiliary bar (13). The rocker rods (3), as shown in FIG. 2B, each comprises a plurality of fastening holes (31) at the lower end for attachment of an adjustable fastening assembly (4) to control the tension of two associated hydraulic cylinders (5). The tension is adjusted by changing the position of fastening assembly (4) on rocker rod (3). The other end of each of the two hydraulic cylinders (5) is pivotedly coupled to the transverse bar (12) of the bottom block (1) at a suitable position.

Two elongated foot-pedals (6) are retained by a steel cord (71), shown in FIG. 3A, by two hooks (61) respectively formed on an edge of the two foot-pedals (6), for suspending the pedals from a pulley block (7). The rear end of each of the two elongated foot-pedals (6) are pivotedly coupled to the support frame (21) at an intermediate portion by means of a pivot bolt (62). The two pivot bolts (62) are used as bearing points to allow the associated elongated foot-pedals (6) to be operated in conjunction with the pulley block (7) for alternatively pedaling to train the legs.

U-shaped bracket (22) is formed at an intermediate portion of the vertical main frame (2) to support a seat (23). The seat (23) comprises a support arm (231) having several locating holes formed therein, at different levels, for mating with a butterfly screw means (221) made on the bracket (22) for adjusting the height of the seat (23). A back cushion (24) is mounted on the vertical main frame (2) at a predetermined position above the seat (23). An electronic counter is mounted on the top of the vertical main frame (2). Below the electronic counter, there is a handlebar (25) mounted on the vertical main frame (2) by means of a butterfly fastening means (251) such that the inclination of the handlebar (25) is adjustable. By means of this arrangement, one may sit on the seat (23 having one's back positioned on the back cushion (24), with one's hands holding the handlebar (25), and with one's legs pedaling the foot-pedals (6). Alternately one could be standing to operate the foot-pedals (6) to exercise the muscles of the legs.

A fixing rod (26) is mounted on each side of vertical main frame (2) adjacent the back cushion (24). Two hydraulic cylinders (8) are each pivotedly coupled on one end to a respective fixing rod (26). The other end of each of the two hydraulic cylinders (8) are connected to a respective foot-pedal, through a transverse slotted through opening (63) formed in each of the associated foot-pedals (6). The cylinders (8) are coupled to the foot-pedals (6) by means of a respective butterfly screw means (81). By loosening of the butterfly screw means (81), the connecting position of the associated hydraulic cylinder (8) in the slotted through opening (63) of each of the associated foot-pedals (6) becomes adjustable. In this way the tension of the hydraulic cylinders 8) may be adjusted to meet a specific requirement.

Figure 2A:
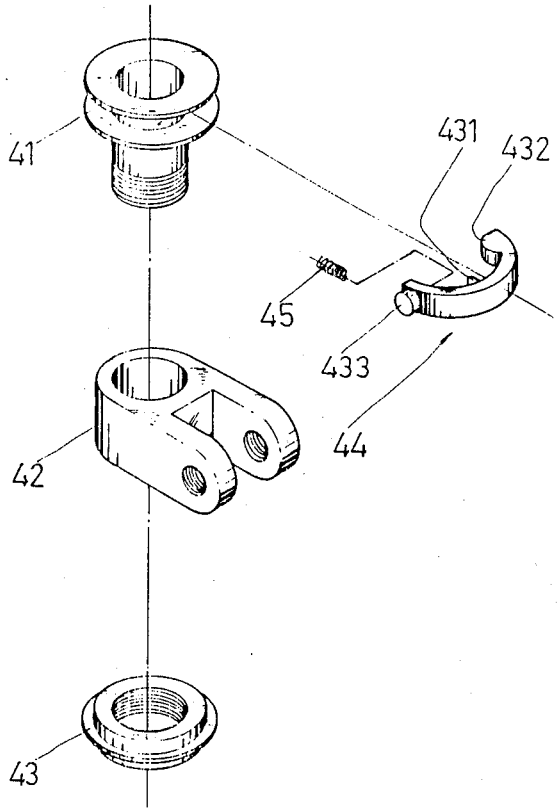
FIG. 2A is an exploded view of the adjustable cylinder fastening assembly of the present invention.
Figure 2B:
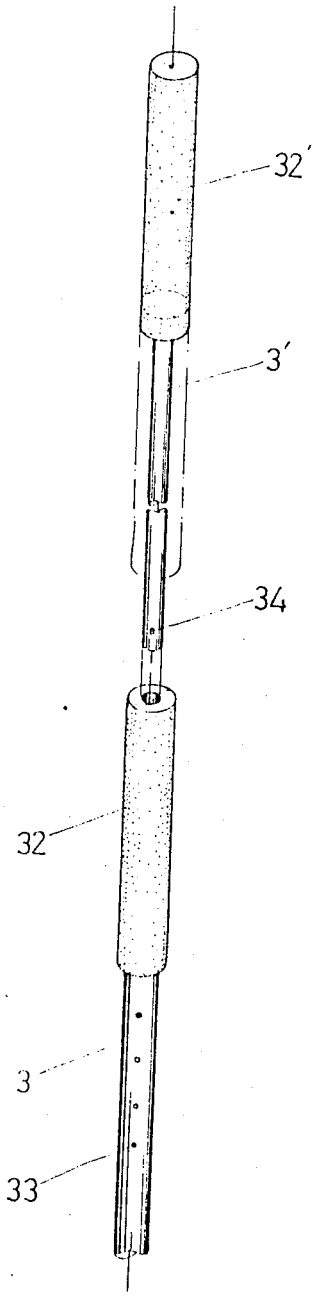
FIG. 2B is an exploded view of the rocker rod assembly of the present invention.

Referring to FIG. 2A, the adjustable fastening assembly(4), which provides the pivotal coupling for each of the two hydraulic cylinders (5) to the two respective vertical rocker rods (3) is shown. Each fastening assembly is respectively comprised of a socket (41), a socket holder (42), and a locking ring (43). After each socket (41) is mounted on a respective rocker rod (3), the associated socket holder (42) is mounted on the socket (41), and the associated locking ring (43) is thus mounted on the socket (41) to lock the socket holder (42) therebetween. The socket (41) comprises two flanges (411) to define an annular groove therebetween for mounting thereon of a curved operation pin (44). The curved operation pin (44) includes two opposing ends, a locking end (432) protruding inwardly, and a pressing end or lug (433) protruding outwardly. The curved operation pin (44) further comprises a centrally located inwardly projecting protrusion (431). When the curved operation pin (44) is mounted on the associated socket (41), the central protrusion (431) is seated in a round hole (412) made on the annular groove between the two flanges (411) of the socket (41). The locking end (432) penetrates through another hole (413) made on the annular groove to engage one of the fastening holes (31) of the respective rocker rod (3). The pressing end (433) is biased outward by a spring (45) operating between the annular groove and the back side of the pressing end (433). Therefore, when the pressing end (433) is pressed down, the locking end (432) breaks away from the associated fastening hole (31) of the associated rocker rod (3), pivoting about the central protrusion (431), to allow adjusting the position of the adjustable fastening means (4) on the rocker rod (3) so as to further adjust the tension of the respective hydraulic cylinder (5) for best performance.

The vertical rocker rods (3) are a kind of telescopic rod. As shown in FIG. 2B, each is comprised of a lower rocker rod (3) and an upper rocker rod (3'). A handle portion (32) is formed on the top of the lower rocker rod (3). A plurality of through holes (33) are formed in the lower rocker rod (3) at suitable locations below the handle portion (32). Another handle portion (32') is formed on the top of the upper rocker rod (3'). One pair of oppositely directed spring biased projections (34) are provided at the lower end of the upper rocker rod (3'). When the upper rocker rod (3') is inserted into the lower rocker rod 3), the two projections (34) are releasably engaged with a pair of respective holes (33) for length adjustment of the handle portion of the rocker rod, so as to adjust for operation by two persons at the same time. One person holding the handle portion (32') of the upper rocker rod (3') and the other person holding the handle portion (32) of the lower rocker ro (3).

Figure 3B:
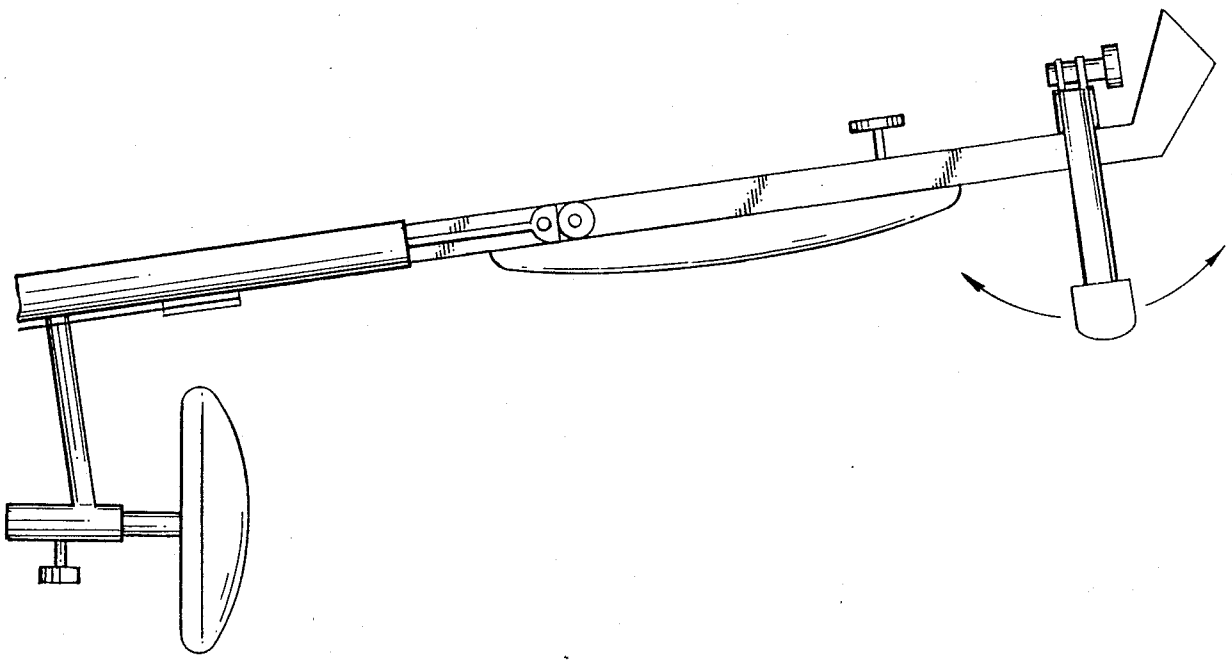
FIG. 3B is an elevation view of a portion of the vertical frame of the present invention.
Figure 3C:
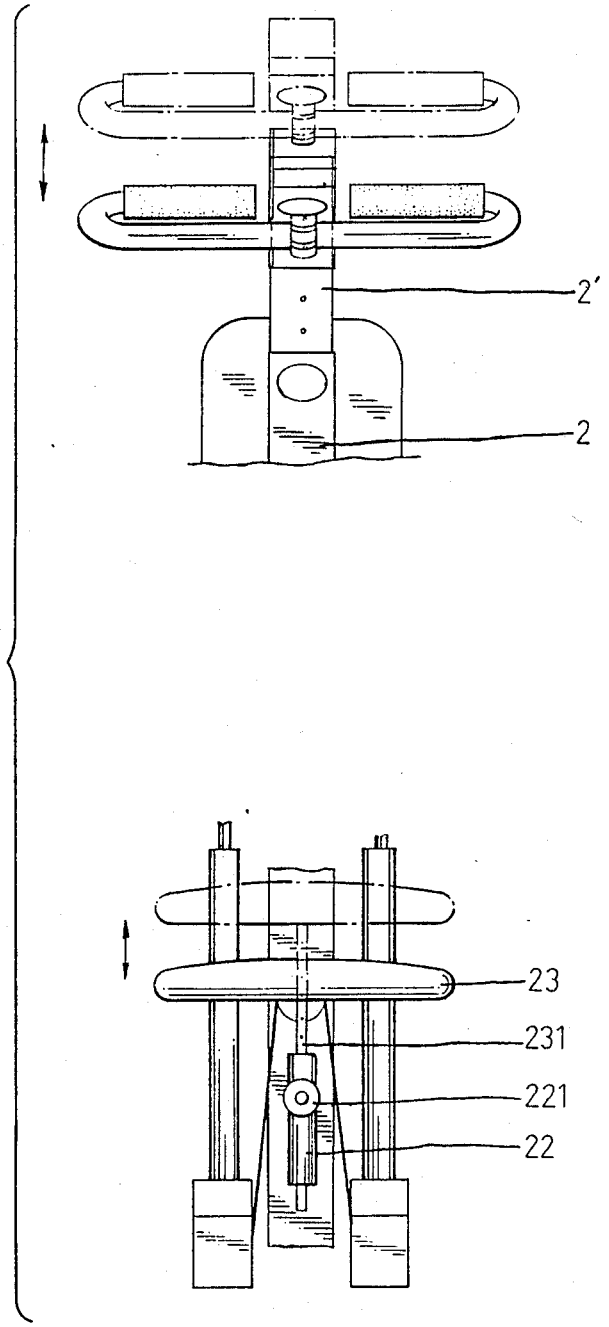
FIG. 3C is a detail view of the vertical frame adjustment assembly and the seat height adjustment assembly of the present invention.

Referring to FIG. 3A, there is shown the means for adjusting the tension of the hydraulic cylinders (8) coupled to the foot-pedals (6). The tension is adjusted by means of changing the position of the coupling location on the foot-pedal through the slotted through opening (63) and the butterfly screw means (81). The height of the seat (23), shown in FIG. 3C, is adjustable by means of the associated butterfly screw means (221). The inclination of the handlebar (25) is also adjustable by means of the adjustment of the associated butterfly screw means (251), as shown in FIGS. 3B and 3C.

Further, referring to FIG. 3A, the pulley block (7) comprises a curved hanger hook (72) located at the top of pulley block (7) for coupling the pulley block to a round hole made on the vertical main frame at a suitable location, for suspending the steel cord (71) on the pulley block (7). Opposing ends of cord (71) are coupled to the hooks (61) of respective foot-pedals (6). When the foot-pedals (6) are not required, the pulley block (7) may be removed to allow the foot-pedals (6) to be placed on the floor, and thereby allowing the exerciser to be ready for exclusively training the arm muscles by means of the rocker rods (3).

The vertical main frame (2) is reversibly expandable, as shown in FIG. 3C, and includes two segments, an inner upper frame (2') and an outer lower frame (2). The upper frame (2') comprises a plurality of through holes (27) respectively made at suitable positions to mate with a butterfly screw means (28) coupled to the lower frame (2), such that the full length of the vertical main frame (2) becomes adjustable for adjusting to the body height of the users.

Figure 4:
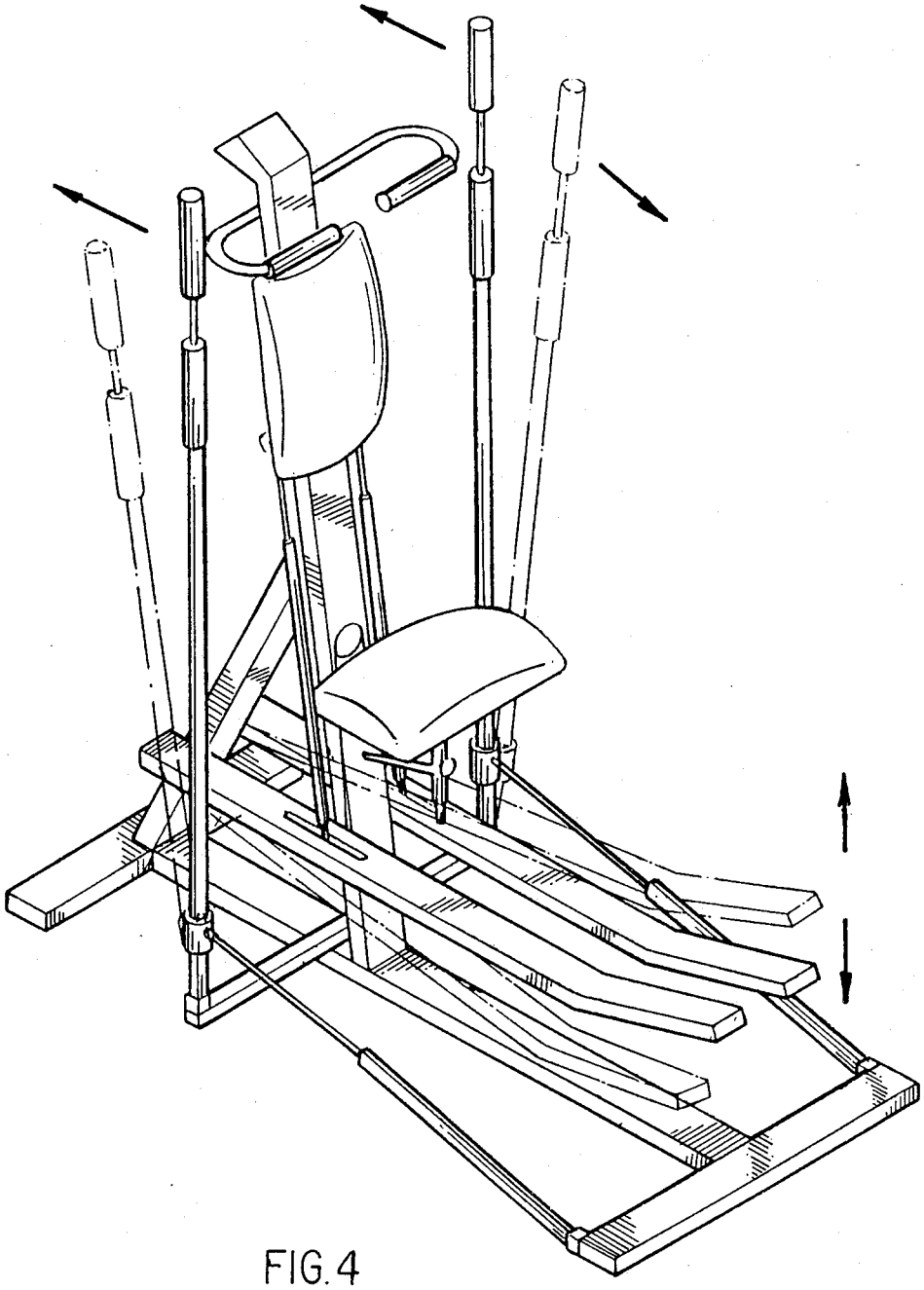
FIG. 4 is a perspective view of the present invention indicating the displacement of foot-pedals and rocker rods; and, FIG. 5 is a perspective view of the three main structural portions of the present invention.

With respect to the operation of the present preferred embodiment, please refer to FIG. 4. One person may sit on the seat (23) with his back against the back cushion (24), having both hands holding the handlebar (25) of the vertical main frame (2), and with both legs pedaling the foot-pedals (6) to exercise both legs. At the same time, two other persons may each stand on opposing sides of the exerciser with their hands holding a respective one of the vertical rocker rods (3), to exercise their arms. Therefore, with the present invention it is possible for three persons to exercise simultaneously.

Figure 5:
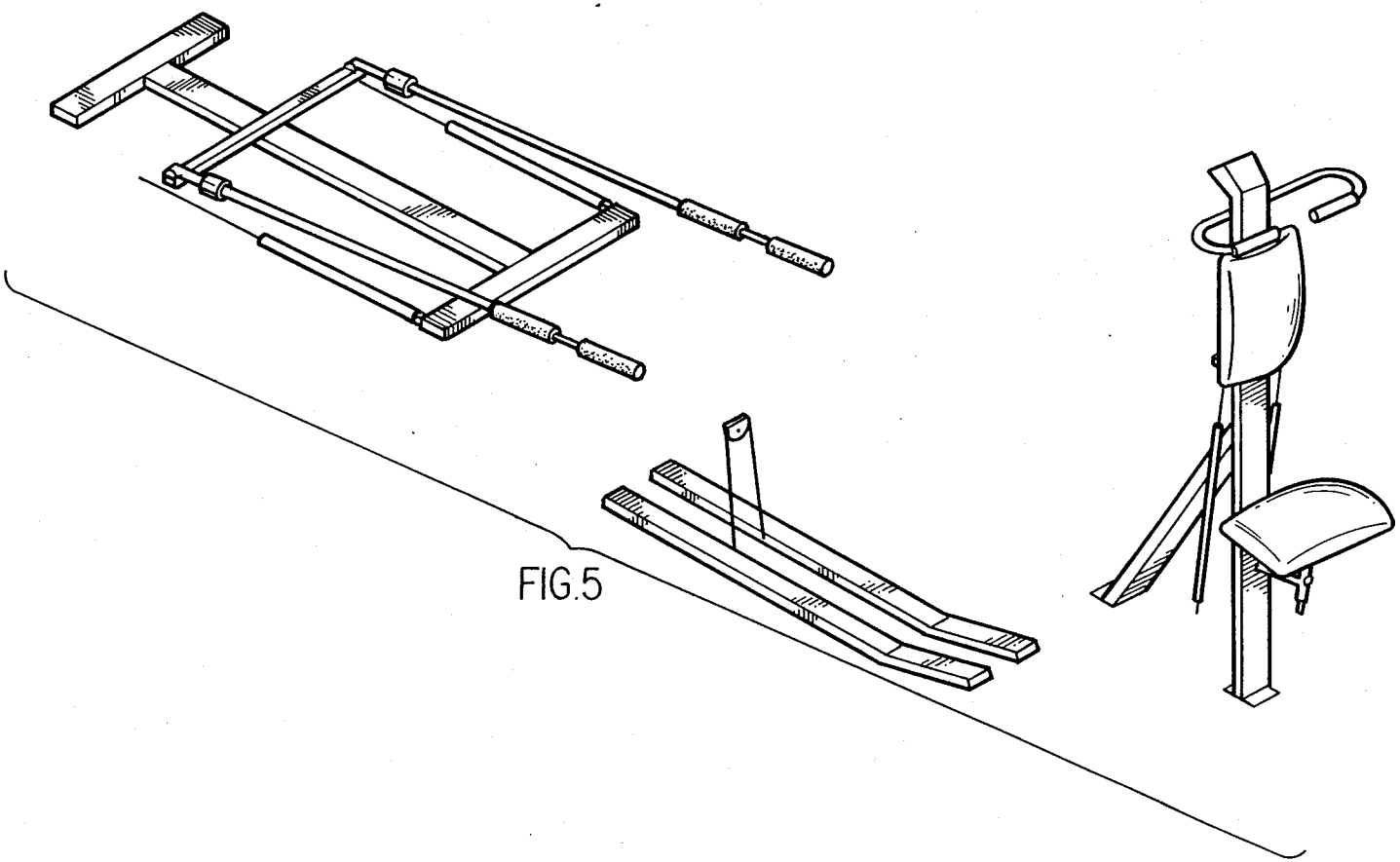

Referring to FIG. 5, the present preferred embodiment may be divided into three main portions for convenient transportation or packaging. The screws which connect the main frame (2) and the support frame (21) to the I-shaped bottom block (1) are removed, and the fastening assembly (4) which pivotedly couple the hydraulic cylinders (5) are loosened, such that the bottom block (1) is fully separated from the main frame (2) and the support frame (21), to become an independent part. Then, the pivot bolts (62) which connect the foot-pedals (6) to the support frame (21) are removed, along with removal of the pulley block (7) from the main frame (2), followed by removal of the butterfly fastening means (81) which couples the hydraulic cylinders (8) to the foot-pedals (6). The foot-pedals (6) and the pulley block (7) can then be separated from the main frame (2) to become another independent portion. Therefore, the remaining main frame and support frame (21) become the third independent section. By means of this arrangement the whole structure is separated into three independent portions for easy transportation or packaging and to minimize storage space requirements.

What is claimed is:

1. A multipurpose body exerciser having a seat and backrest, comprising:

an I-shaped base frame having a longitudinally extended central member and a pair of transverse members coupled on opposing ends thereof;

vertical frame means coupled to said central member of said I-shaped base frame for supporting said seat and backrest;

a transversely directed auxiliary bar member coupled to said central member adjacent said vertical frame means;

means for exercising arm muscles coupled to said auxiliary bar member, said means for exercising arm muscles including a pair of telescoping rocker rods pivotedly coupled to opposing ends of said auxiliary bar member for defining a pair of force applying levers, and a pair of first hydraulic cylinders pivotedly coupled on a first end to said I-shaped base frame, each of said first hydraulic cylinders being pivotedly coupled on a second end to adjustable fastening means for varying a resistive force applied to said rocker rods, said adjustable fastening means being releasably lockingly coupled to a respective rocker rod at a selected one of a plurality of predetermined locations;

a pair of foot-pedals, each of said foot-pedals being pivotedly coupled on one end to said vertical frame means;

pulley means having a steel cord coupled on opposing ends to each of said foot-pedals for causing a responsive opposing displacement of one foot-pedal relative to the other; and, a second pair of hydraulic cylinders pivotedly coupled on a respective first end to said vertical frame means, each of said second hydraulic cylinders being pivotedly coupled on a second end to a respective one of said foot-pedals for applying a resistive force thereto.

2. The multipurpose body exerciser as recited in claim 1 where said adjustable fastening means includes:

an annular socket member having a central through opening for encompassing a portion of a respective one of said rocker rods and a pair of spaced apart substantially parallel annular flanges;

a socket holding member coupled to said annular socket member and to said second end of a respective first hydraulic cylinder;

an accurate pin member pivotedly mounted between said annular flanges of said annular socket member, said accurate pin member having an inwardly directed projection on one end thereof extending through and aligned with a through opening formed in said annular socket member for reversibly engaging one of a plurality of through openings formed in a respective one of said rocker rods, said accurate pin member further having a centrally located inwardly directed projection about which said accurate pin member pivots responsive to a force being applied on the opposing end thereof; and, a spring coupled to said opposing end of said arcuate pin member for applying a bias force thereto.

3. The multipurpose body exerciser as recited in claim 1 where each of said rocker rods includes a lower portion and an upper handle portion reversibly lockingly extendable from said lower portion.

* * * * *